US006260727B1

(12) United States Patent
Durdon

(10) Patent No.: US 6,260,727 B1
(45) Date of Patent: Jul. 17, 2001

(54) DISPOSABLE CUP LID HAVING FOLD BACK RETAINER

(75) Inventor: Terry Durdon, Guelph (CA)

(73) Assignee: Amhil Enterprises

( * ) Notice: Subject to any disclaimer, the term of this patent is extended or adjusted under 35 U.S.C. 154(b) by 0 days.

(21) Appl. No.: 09/468,585

(22) Filed: Dec. 21, 1999

(51) Int. Cl.[7] ..... A47G 19/22

(52) U.S. Cl. ..... 220/254; 220/832; 220/270; 220/715

(58) Field of Search ..... 220/254, 259, 220/831, 832, 266, 268, 712, 713, 714, 715, 270, 711

(56) References Cited

U.S. PATENT DOCUMENTS

| | | | | |
|---|---|---|---|---|
| D. 354,438 | * | 1/1995 | Miller | D9/438 |
| 3,994,411 | | 11/1976 | Elfelt et al. . | |
| 4,202,459 | | 5/1980 | DeParales et al. . | |
| 4,322,015 | | 3/1982 | Bailey . | |
| 4,460,103 | | 7/1984 | Rama et al. . | |
| 4,629,088 | | 12/1986 | Durgin . | |
| 4,738,373 | * | 4/1988 | DeParales | 220/254 |
| 4,753,365 | * | 6/1988 | Seppala | 220/713 X |
| 4,760,934 | * | 8/1988 | Netsch | 220/254 X |
| 5,090,584 | * | 2/1992 | Roberts et al. | 220/712 |
| 5,111,961 | | 5/1992 | VanMelle . | |
| 5,197,624 | * | 3/1993 | Dodaro | 220/254 |
| 5,335,812 | * | 8/1994 | Boller | 220/713 X |
| 5,348,181 | * | 9/1994 | Smith et al. | 220/254 |
| 5,490,609 | | 2/1996 | Lane et al. . | |
| 5,613,619 | | 3/1997 | VanMelle . | |
| 5,699,927 | | 12/1997 | Lane et al. . | |
| 5,839,601 | | 11/1998 | VanMelle . | |
| 5,911,331 | * | 6/1999 | Boller | 220/254 |
| 5,947,323 | * | 9/1999 | Freek et al. | 220/254 X |
| 6,089,397 | * | 7/2000 | Van Melle | 220/254 X |

* cited by examiner

*Primary Examiner*—Nathan J. Newhouse
(74) *Attorney, Agent, or Firm*—Marks & Clerk

(57) ABSTRACT

A disposable cup lid for placement onto a drinking cup is provided, having a tear tab which is generally aligned with the orientation of the extruded plastic sheet material from which the cup lid is made. There is a first, generally centrally located region in the lid, which has a higher elevation than the cup rim receiving recess at the periphery of the lid; and there is an indentation formed in the central region which is provided so as to accommodate the tear tab when it is folded back around a U-shaped hinge to create a drink-through opening in the cup lid. The indentation has a pair of detents located at its edges so as to hold and retain the tear tab in place when the foldback flap is folded back about the U-shaped hinge and the tear tab is inserted into the indentation. The tear tab is retained below the plane of the central region of the cup lid.

6 Claims, 2 Drawing Sheets

DISPOSABLE CUP LID HAVING FOLD BACK RETAINER

FIELD OF THE INVENTION

This invention relates to disposable lids for placement on drinking cups; and more particularly the present invention is directed to a disposable cup lid which has a drink-through opening therein and which is such that when the foldback flap defining the drink-through opening is in its folded-back position, the tear tab which is used to initiate tearing of the cup lid so as to form the foldback flap and drink-through opening will be retained in an indentation formed in the cup lid below the plane of the central region thereof. Accordingly, lids which are in keeping with the present invention have the advantage that the tear tab is retained in place when the foldback flap is in its folded-back position, and therefore the tear tab does not interfere particularly with the nose of a person drinking from the cup on which the cup lid of the present invention has been placed.

BACKGROUND OF THE INVENTION

Disposable cup lids having drink-through openings are very well known. The advantage of a drink-through opening is that the lid does not need to be removed from the cup in order to drink the beverage which is contained in the cup. This is particularly advantageous when the beverage is a hot beverage, such as coffee or tea.

It is becoming more popular, particularly in the take-out food and beverage industry, to provide specialty coffees and the like, which coffees may have some froth or foam at the top of the beverage when it is dispensed into a drinking cup, and therefore a dome or semi-dome lid is appropriate. That means to say, that at least a portion of the disposable cup lid which is placed on the drinking cup should extend above the rim of the cup. Semi-dome lids are also advantageous in other circumstances; for example in most hot beverages they permit accumulation of steam, they provide some volume for the beverage to splash around in without leaking past the cup rim, and in the case of cold beverages they provide a bit of additional volume for foam or for ice cubes floating in the beverage to occupy.

However, a disadvantage of any such dome or semi-dome lids, heretofor, particularly those which have foldback flaps that define drink-through openings, is that the tear tab which must first be manipulated to cause the tearing back of the material of the disposable cup lid, generally extends upwardly above the central region of the cup lid and therefore it interferes with the nose of a person consuming a beverage from a cup on which the cup lid has been placed.

The present invention overcomes that disadvantage by provided a structure wherein the tear tab is retained in an indentation formed in the cup lid so as to be in a position below the plane of the generally central region of the cup lid, and therefore so as to not interfere with the nose of the user.

The present invention is, of course, directed to disposable cup lids which are intended to have a plug fit on the rim of the drinking cup on which they are placed. That means that there is a recess formed on the underside of the disposable cup lid, at or very near the other periphery thereof, and the recess will accommodate the rim of the drinking cup at both its inside and outside extremities. Thus, the rim of the drinking cup will extend upwardly into the downwardly directed cup rim engaging recess so as to hold the rim of the drinking cup more securely in place.

Notwithstanding the prior art which is discussed hereafter, the inventor herein has unexpectedly discovered that disposable cup lids may be provided for placement onto a drinking cup where the disposable cup lids have a semi-dome configuration and yet they may be formed in such a manner that there is no unwanted interference of the nose of the user by the tear tab and foldback flap which define the drink-through opening of the cup lid. Moreover, such a cup lid that permits easy access and formation of the drink-through opening permitting resealing of the opening, in keeping with the present invention is capable of being manufactured using conventional machinery.

2. Description of the Prior Art

ELFELT el al. U.S. Pat. No. 3,994,411, issued Nov. 30, 1976 teaches a cup lid having a foldback drink opening in which the drink-through opening is defined at its edges by a series of perforations formed in the cup lid; and in which the grab tab is tucked or inserted into a slit formed in the cup lid in a position opposite the grab tab.

U.S. Pat. No. 4,202,459, issued May 13, 1980 to DePARLES et al. teaches a cup lid where slits are cut into the lid during fabrication to permit tearing back of the fold back flap where a portion of the peripheral rim-engaging segment is inserted into a cooperating slot. This, however, leaves the rim of the cup lid extending upwardly into the air where it may interfere with the nose of the user.

BAILEY U.S. Pat. No. 4,322,015, issued Mar. 30, 1982, teaches a cup lid where the fold back access strip may be releasedly retained by being placed between a pair of spaced protrusions formed in the cup lid.

RAMA et al. U.S. Pat No. 4,460,443 issued Jul. 17, 1984 teaches a drink lid or cover which is particularly intended for cups having hot beverages in them. The cup lid fits snugly to the cup and provides a openable flap through which ingredients such as cream and sugar may be added to the beverage, and through which the beverage may be consumed. The cup lid is substantially flat, and has an upper surface which extends downwardly into the cup so as to lie below the surface of the rim of the cup. A raised pull tab is provided to lift the flap so that it may be folded back, after which the pull tab is inserted into a matching wall.

U.S. Pat. No. 4,629,088 issued Dec. 16, 1986 to DURGIN teaches a beverage container having a foldable flap which is open to allow the user to drink through the beverage container. The container lid is essentially flat, with the major plane thereof lying in the same plane as the rim of the cup. The cup lid provides a pair of detents and an end overhang, which cooperate to hold the flap in place within a recess which is formed in the plane of the cup lid to accommodate the foldable flap.

A further United States patent to DePARLES, U.S. Pat. No. 4,738,373 issued April 1988 teaches a cover for a disposable drinking cup where the cover has a hinged tab defined by score lines. A recess is provided to accommodate the foldback flap, but once again, the tear tab remains exposed above the cup lid.

LANE et al. U.S. Pat. No. 5,490,609 issued Feb. 13, 1996, and U.S. Pat. No. 5,699,927 issued Dec. 23, 1997 have essentially identical disclosures. Each patent teaches a beverage cup lid which is substantially flat where the major plane of the cup lid lies below the rim of the cup. In each case, the cup lid has a drink-through opening which is covered by a hinged closure member which may be locked in place by trapping an outer marginal edge of the closure between the cup rim and the periphery of the lid. The manufacturer of the LANE et al. cup lids, however, requires that the closure member must be manipulated during manufacture of the cup lid such as by being pulled so as to stretch the plastic in a radial direction.

VAN MELLE U.S. Pat. No. 5,111,961, issued May 12, 1992, teaches a substantially flat cup lid in which the foldback portion is formed simply as a consequence of the extrusion grain of the plastic material of the lid. The foldback portion is hinged about a U-shaped type hinge and is retained in place by the cooperation of a pair of protruding tabs with a co-operating protrusion. This, however, leaves the grasp tab of the lid exposed above the plane of the cup lid.

A further patent to VAN MELLE U.S. Pat. No. 5,613,619 issued Mar. 25, 1997 teaches an improved foldback cup lid wherein the foldback portion of the lid is, at least in part, receive in a recess formed in the lid.

Finally, VAN MELLE U.S. Pat. No. 5,839,601, issued Nov. 24, 1998, teaches a disposable dome lid for drinking cups. The dome lid is configured so as to have a plug fit onto the rim of the beverage cup, and provides a side surface of the dome which depends downwardly from a substantially planar top surface of the lid, and which is inset from the cup rim engaging recess. This provides a surface for engaging the lower lip of the mouth of the user. A tear-back flap is defined by fault lines which are stamped into the top surface of the dome lid, and a U-shape hinge formed in the top surface. The tear-back flap may be folded back and locked into place by placing a locking stub into a locking recess.

SUMMARY OF THE INVENTION

The present invention provides a disposable cup lid for placement onto a drinking cup having an opening at its upper end, where the opening is defined by a substantially circular cup rim whose upper extremity ties substantially in a single plane. The disposable cup lid is thermoformed from extruded plastic sheet material having a linear extrusion grain.

Cup lids in keeping with the present invention comprise a substantially planar top surface in a first region of the cup lid, which extends on both side of the center line thereof, which center line is disposed substantially perpendicular to the linear extrusion grain of the plastic sheet material from which the disposable cup lid has been manufactured. The cup lid also has an axis of symmetry extending along a center line of the cup and aligned with the linear extrusion grain.

There is a downwardly facing cup rim engaging recess which is formed near the outer periphery of the disposable cup lid, and which is defined by an outer downwardly directed recess side wall, an inner downwardly directed recess side wall, and a top recess wall, spanning between the outer and inner downwardly directed recess side walls. The top recess wall lies substantially in a plane which is below the plane occupied by the top surface of the cup lid—thereby giving the cup lid a semi-dome configuration.

There is a second region of the cup lid near the periphery thereof, and opposed to the first region. The second region is located on either side of the axis of symmetry, and is in a plane which is substantially below the plane of the top recess wall.

A tear tab is provided, and it is aligned with the axis of symmetry and extends outwardly from the outer downwardly directed recess side wall in a plane which is below the plane occupied by the second region of the cup lid.

An indentation is formed in the substantially planar top surface of the cup lid, at an edge thereof which is adjacent the second region.

There is a depressed "U"-shaped hinge formed in the second region, and it is substantially perpendicular to the axis of symmetry.

The width of the indentation is dimensioned so as to receive the tear tab therein when a drink-through opening is formed in the second region by lifting the tab, tearing back a foldback flap in the second region of the cup lid up to the "U"-shaped hinge, and folding back the foldback flap about the "U"-shaped hinge.

Moreover, the depth of the indentation is such that, when the tear tab is received therein, the tear tab is below the plane of the substantially planar top surface of the cup lid.

The indentation has a pair of detents formed one at each side thereof. Thus, when the tear tab is received in the indentation, it is retained therein by interference between the edges of the tear tab and the detents.

A particular feature of the present invention is that, electively, at least one rib may be formed in the second region, in the region thereof between the "U"-shaped hinge and the inner downwardly directed recessed side wall. The at least one rib is disposed in a direction parallel to the linear extrusion grain.

In another feature of the present invention, the indentation is defined in the region thereof which is remote from and parallel to the "U"-shaped hinge by a wall which extends downwardly and substantially perpendicularly from the substantially planar top surface.

Typically, the bottom of the indentation is downwardly curved.

Yet another feature of the present invention provides for a curved recess being formed in the second region at a distance from the "U"-shaped hinge on the side thereof which is remote from the periphery of the cup lid. The curved recess is dimensioned so as to accommodate that portion of the cup lid engaging recess which is in the foldback flap, when the foldback flap is folded about the "U"-shaped hinge and the tear tab is received in the indentation which is provided therefor.

At least a portion of the edge of the curved recess which is closest to the "U"-shaped hinge may extend above the plane of the second region.

Accordingly, it is an object of the present invention to provide a disposable cup lid which, contrary to the prior art permits easy retention of the foldback flap by engaging the tear tab in an indentation therefor, whereby the tear tab is retained in a position below the principal plane of the central region of the cup lid.

Moreover, an object of the present invention is to provide such a cup lid as described above, which has a semi-dome configuration.

These and other objects and advantages of the present invention are described hereafter.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

Figure 1:
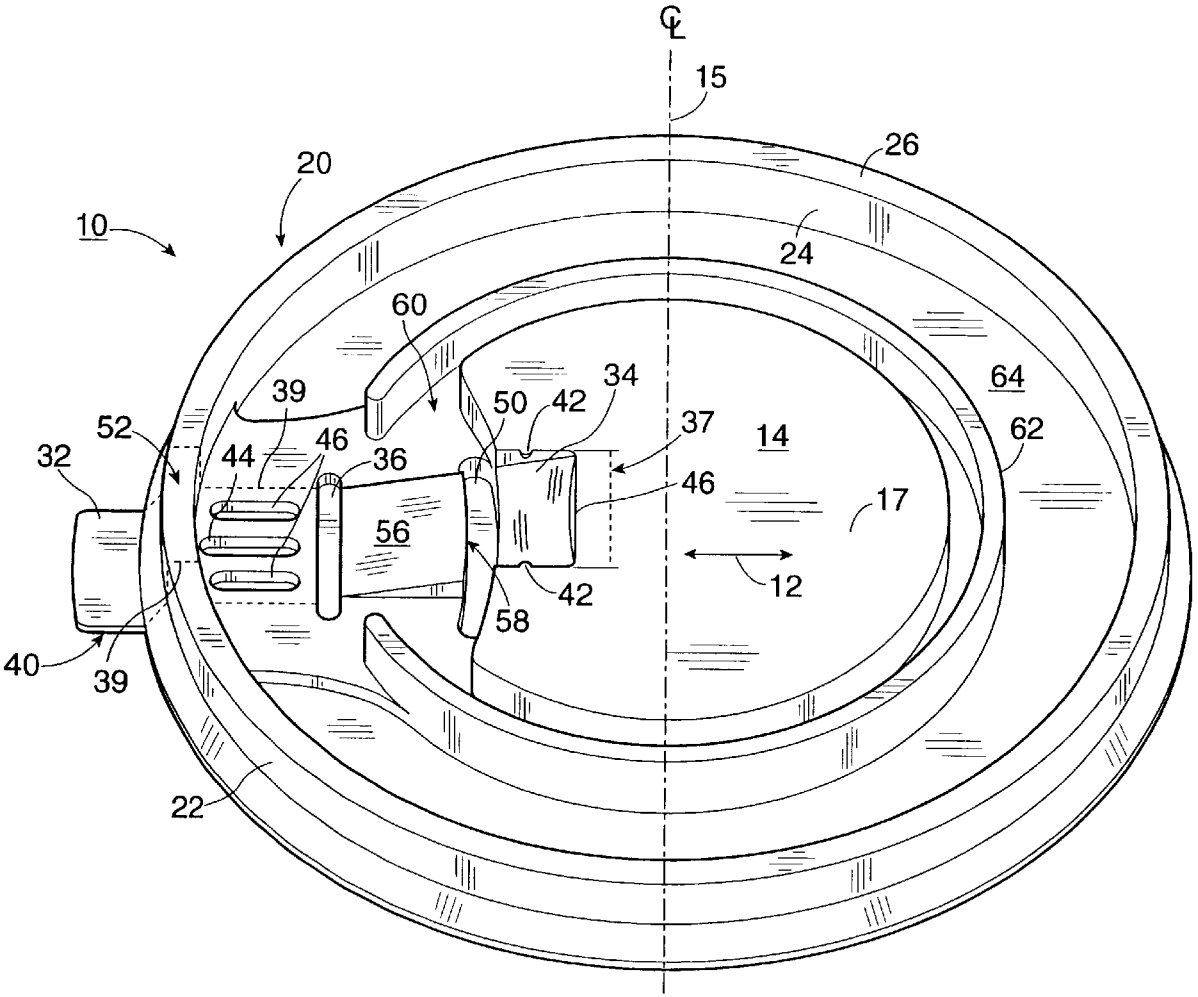
FIG. 1 is a perspective view of a first preferred embodiment of disposable cup lid, in keeping with the present invention.

DETAILED DESCRIPTION OF THE PREFERRED EMBODIMENTS:

Referring first to FIG. 1, a perspective view of a preferred embodiment of the disposable cup lid of the present invention is shown. As noted above, FIGS. 2 and 4 provide cross-sections of a slightly different embodiment, which differs only in the configuration of the indentation, as described hereafter.

The cup lid 10 is, of course, intended to be placed over the open upper end of a drinking cup. Typically, such a drinking cup may be made from plastic or other coated paper, polystyrene, styrene, or otherwise; and, in any event, the drinking cup will have a substantially circular cup rim which lies substantially in a single plane. The disposable cup lid 10 is thermoformed from an extruded plastic sheet material, which has a linear extrusion grain indicated by the double-headed arrow 12.

There is a substantially planar top surface 14 which is formed in a first region of the cup lid, which first region extends on both sides of a center line 15. The center line 15 is disposed substantially perpendicular to the linear extrusion grain indicated by the arrow 12. There is also an axis of symmetry 17 which extends along a center line of the cup lid so as to be aligned with the linear extrusion grain. Accordingly, the axis of symmetry 17 is perpendicular to the center line 15.

A downwardly facing cup rim engaging recess 20—see FIGS. 2 through 5, in particular—is formed near the outer periphery of the disposable cup lid. The cup rim engaging recess 20 is defined by an outer downwardly directed recess side wall 22, an inner downwardly directed recess side wall 24, and a top recess wall 26 which spans between the inner and outer downwardly directed recess side walls 22, 24. The top recess wall 26 lies substantially in a plane which is below the plane of the top surface 14.

Figure 2:
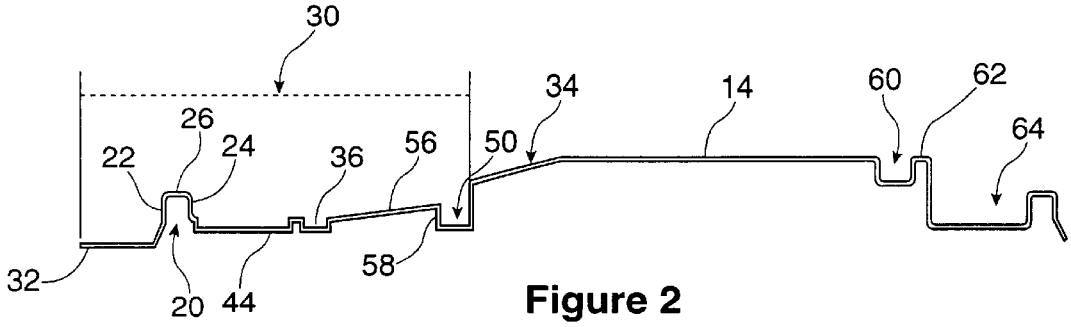
FIG. 2 is a cross-section of a general embodiment of cup lid in keeping with the present invention.
Figure 3:
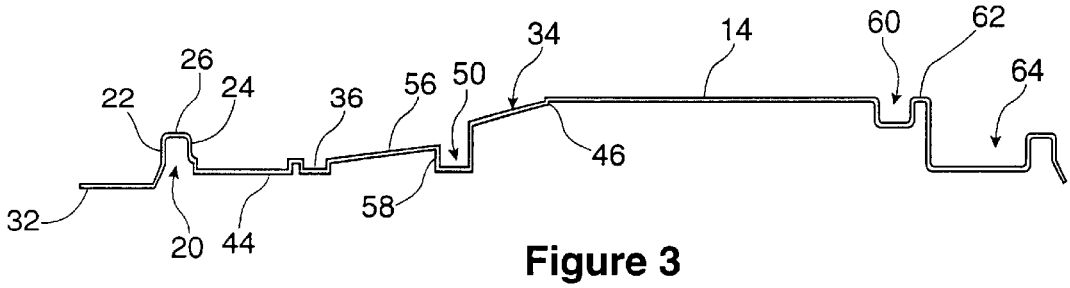
FIG. 3 is a cross-section similar to that shown in FIG. 2, but of the embodiment shown in FIG. 1.

There is a second region of the cup lid 10, which is indicated generally at 30 in FIG. 2. The second region 30 lies near the periphery of the cup lid 10, and is opposed to the first region occupied by the substantially planar top surface 14. The second region 30 is located on either side of the axis of symmetry 17, and—while not precisely planar—the second region can be said to be substantially in a plane which, in any event, is below the plane of the top recess wall 26, and is therefore below the plane of the planar top surface 14.

A tear tab 32 is aligned with the axis of symmetry 17, and it extends outwardly from the outer downwardly directed recess side wall 22, in a plane which is below the plane occupied by the second region 30.

An indentation is shown generally in FIG. 1 at 34; and that indentation is formed in the substantially planar top surface 14 at the edge thereof which is adjacent the second region 30—as can be seen in each of FIGS. 1 through 5.

There is a depressed "U"-shaped hinge 36 which is shown being formed in the second region 30. The "U"-shaped hinge 36 is substantially perpendicular to the axis of symmetry shown by arrows 12.

The width of the indentation 34 is shown at 37. That dimension is just sufficient to receive the width of the tear tab 32 when the drink-through opening is formed in the second region 30 of the cup lid 10. The drink-through opening is formed by lifting the tear tab 32, and tearing back along the linear extrusion grain so that tear lines 39 will develop. Those tear lines 39 terminate, however, at the "U"-shaped hinge 36. A foldback flap 40 is thereby formed; and the foldback flap 40 is folded back about the "U"-shaped hinge 36, as shown in FIGS. 4 and 5.

Figure 4:
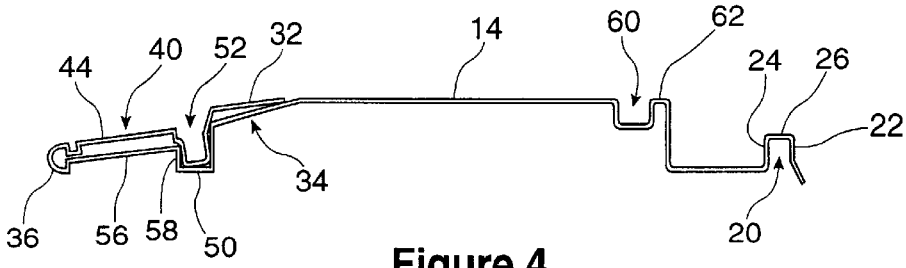
FIG. 4 is a cross-section of the embodiment of FIG. 2, with the foldback flap in folded-back position.
Figure 5:
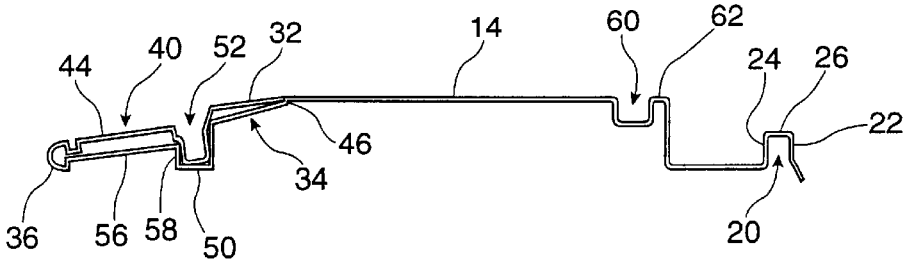
FIG. 5 is a view similar to that shown in FIG. 4, but in respect of the embodiment shown in FIG. 1.

The depth of the indentation 34 is sufficient that, when the tear tab 32 is received therein, as shown in FIGS. 4 and 5, the tear tab 32 is located below the plane of the substantially planar top surface 14.

There is a pair of detents 42 which are formed, one at each side of the indentation 34. Typically, the detents extend outwardly and downwardly from the plane of the top surface 14. It will be recalled that the material of the present invention is thermoformed plastic sheet material, which has some resiliency. Therefore, when the tear tab 32 is placed into the indentation 34, the edges of the tear tab 32 will be located slightly below the detents 42; and thus, the tear tab 32 will be retained in the indentation 34 by interference between the edges of the tear tab 32 and the detents 42.

At least one rib 44 is formed in the second region 30, in the region thereof which is between the "U"-shaped hinge 36 and the inner downwardly directed recess side wall 24. In FIG. 1, two additional or auxiliary ribs 46 are also shown. The rib 44, or ribs 44, 46, in any event, are disposed in a direction which is parallel to the linear extrusion grain shown at arrow 12. The purpose of the rib 44, or ribs 44, 46, is to provide additional stiffness to the foldback flap 40. Moreover, the ribs 44, 46 promote tearing back of the lid along the tear lines 39, all the way to the "U"-shaped hinge 36.

In a preferred embodiment of the present invention, the indentation 34 is defined at its back edge—the region of the indentation 34 which is remote from and parallel to the "U"shaped hinge 36—by a wall 46. The presence of the wall 46 provides additional stiffness to the central portion or first region of the cup lid 10, particularly in respect of the generally planar top surface 14. Accordingly, the wall 46 is configured so as to extend downwardly and substantially perpendicularly from the substantially planar top surface 14.

Generally, the bottom surface of the indentation 34 is downwardly curved; but it is also sloped downwardly in a direction generally towards the "U"-shaped hinge 36. This allows for the placement of the tear tab 30 into the indentation 34, and retention therein by the detents 42. The side-to-side and downward curvature of the bottom of the indentation 34 permits a fingernail, for example, to be placed under the tear tab 32 when it is retained in place within the indentation 34, to remove the tear tab 32 so as to place the foldback flap 40 back into position with the drink-through opening thus being closed.

The second region 30 may also include a curved recess 50, which is formed in the second region 30 at a distance from the "U"-shaped hinge 36 and on the side thereof which is remote from the periphery of the cup lid 10, and remote from the tear tab 32. The curved recess 50 is dimensioned so as to accommodate that portion 52 of the cup rim engaging recess 20 which is in the foldback flap 40, when the foldback flap 40 is folded back about the "U"-shaped hinge 36 and the tear tab 32 is received in the indentation 34. That condition is shown, particularly, in each of FIGS, 4 and 5.

A particular embodiment of the placement of the curved recess 50 is also illustrated in the Figures, where a sloped surface 56 is formed in the second region 30 behind the "U"-shaped hinge 36, between the "U"shaped hinge 36 and the curved recess 50. This has the effect of providing that at least a portion of the edge of the curved recess 50, shown at 58, extends above the plane of the second region—that area of the second region which is essentially occupied between the inner downwardly directed recess side wall 24 as it extends rearwardly (to the right in any of the Figures). The elevated portion 58 thus extends upwardly towards the planar top surface 14, and the first region of the cup lid 10 which it occupies. This elevated portion 58 of the edge of the curved recess 50 allows for more significant engagement or capture of the portion 52 of the downwardly facing cup lid engaging recess 20, when the foldback flap 40 is in its folded-back position. Particularly, there is engagement between the elevated edge portion 58 of the curved recess 50, and the recessed side wall 24, as can be seen in FIGS. 4 and 5.

Several other features of the cup lid of the present invention are also illustrated in FIG. 1. They include a further circular recess 60, which is formed in the central or first region of the cup lid 10, surrounding the central substantially planar top surface 14. The recess 60 is bounded by a further upwardly directed wall 62; and its purpose is to receive the bottom edge of a paper cup so that a plurality of lidded paper cups may be more easily carried in stacked relationship with less likelihood of slippage and therefore with greater stability.

There is a further recess 64 which is formed between the wall 62 and the wall 24, whereby the inner downwardly directed recess side wall 24 is defined so as to ensure a plug fit of the cup lid onto a drinking cup. The general configuration of the cup lid 10, comprising as well the wall 62 defining the recess 60, is such as to have significant stiffness against torsion and twisting, and with a relatively stiff central portion.

It will be clear from all of the above that the structure of the present invention provides a semi-dome cup lid having a larger volume above the rim of the drinking cup onto which the cup lid is placed, than is provided in most of the generally flat—that is, non-dome—disposable cup lids of the prior art.

It is noted from the above discussion, and an inspection of the accompanying drawings, that clearly there should be no interference of the tab 32 with the nose of the user when the tear tab 32 is in place in the indentation 34, as illustrated in FIGS. 4 and 5.

Thus, there has been described a disposable cup lid, and various embodiments thereof, which satisfies the aims and objectives of the present invention by providing an inexpensive, easily manufactured cup lid having a semi-dome configuration and where the tear tab is completely out of the way and presents no opportunity for interference with the nose of the user, when in place. Other embodiments and variations of the disposable cup lid in keeping with the present invention may be realized, without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially circular means defining a circular or having the property of circularity; likewise, substantially planar means being in a plane or having the general characteristics associated with being planar.

What is claimed is:

1. A disposable cup lid for placement onto a drinking cup having an opening at its upper end, said opening being defined by a substantially circular cup rim whose upper extremity lies substantially in a single plane;

wherein said disposable cup lid is thermoformed from extruded plastics sheet material having a linear extrusion grain, and comprises:

a substantially planar top surface in a first region of said cup lid which extends on both sides of a center line thereof, which center line is disposed substantially perpendicular to said linear extrusion grain;

an axis of symmetry extending along a center line of said cup lid and aligned with said linear extrusion grain;

a downwardly facing cup rim engaging recess formed near the outer periphery of said disposable cup lid, said cup rim engaging recess being defined by an outer downwardly directed recess sidewall, an inner downwardly directed recess sidewall, and a top recess wall spanning between them, wherein said top recess wall lies substantially in a plane below the plane occupied by said substantially planar top surface;

a second region of said cup lid near the periphery thereof and opposed to said first region, said second region being located on either side of said axis of symmetry and substantially in a plane below the plane of said top recess wall;

a tear tab aligned with said axis of symmetry and extending outwardly from said outer downwardly directed recess sidewall in a plane below the plane occupied by said second region;

an indentation formed in said substantially planar top surface at an edge thereof adjacent to said second region;

a depressed U-shaped hinge formed in said second region and being substantially perpendicular to said axis of symmetry;

wherein the width of said indentation is dimensioned so as to receive said tear tab therein when a drink-through opening is formed in said second region by lifting said tab, tearing back a foldback flap in said second region up to said U-shaped hinge, and folding back said foldback flap about said U-shaped hinge; and wherein the depth of said indentation is such that, when said tear tab is received therein, said tear tab is below the plane of said substantially planar top surface;

said indentation halting a pair of detents formed one at each side thereof;

whereby, when said tear tab is received in said indentation, it is retained therein by interference between the edges of said tear tab and said detents.

2. The disposable cup lid of claim 1, wherein at least one rib is formed in said second region in the region thereof between said U-shaped hinge and said inner downwardly directed recess sidewall; and wherein said at least one rib is disposed in a direction parallel to said linear extrusion grain.

3. The disposable cup lid of claim 1, wherein said indentation is defined in the region thereof which is remote from and parallel to said U-shaped hinge by a wall which extends downwardly and substantially perpendicularly from said substantially planar top surface.

4. The disposable cup lid of claim 1, wherein the bottom of said indentation is downwardly curved.

5. The disposable cup lid of claim 1, wherein a curved recess is formed in said second region at a distance from said U-shaped hinge on the side thereof remote from the periphery of said cup lid; and wherein said curved recess is dimensioned so as to accommodate that portion of said cup rim engaging recess which is in said foldback flap, when said foldback flap is folded back about said U-shaped hinge and said tear tab is received in said indentation.

6. The disposable cup lid of claim 5, wherein at least a portion of the edge of said curved recess which is closest to said U-shaped hinge extends above the plane of said second region.

* * * * *